US006853348B1

(12) United States Patent
Jung et al.

(10) Patent No.: US 6,853,348 B1
(45) Date of Patent: Feb. 8, 2005

(54) DUAL BAND LINEAR ANTENNA ARRAY

(75) Inventors: Chi Hsiang Jung, Taipei (TW); Lai Zih Sheng, Taipei (TW); Kuo Kuo Hsun, Taipei (TW)

(73) Assignee: Golden Bridge Electech Inc., Taipei (TW)

( * ) Notice: Subject to any disclaimer, the term of this patent is extended or adjusted under 35 U.S.C. 154(b) by 6 days.

(21) Appl. No.: 10/641,140

(22) Filed: Aug. 15, 2003

(51) Int. Cl.[7] ..... H01Q 21/00
(52) U.S. Cl. ..... 343/810; 343/893
(58) Field of Search ..... 343/702, 810, 343/787, 890, 893

(56) References Cited

U.S. PATENT DOCUMENTS 4,320,760 A * 3/1982 Sun et al. ..... 606/204
5,521,608 A * 5/1996 Brandt et al. ..... 343/749
6,275,197 B1 * 8/2001 Behr ..... 343/890
6,369,770 B1 * 4/2002 Gothard et al. ..... 343/794
6,492,959 B1 * 12/2002 Heatherwick et al. ..... 343/890
6,529,172 B2 * 3/2003 Zimmerman ..... 343/797
2003/0193446 A1 * 10/2003 Chen ..... 343/893
2004/0075615 A1 * 4/2004 Engargiola et al. ..... 343/810

* cited by examiner

*Primary Examiner*—Tan Ho

(57) ABSTRACT

A dual band linear antenna array, having a set of radiator constructed by four hard linear conductors. The linear conductors are equidistantly arranged at four corners and extend parallel to each other. By serially connecting to a signal feed terminal, the roots of the linear conductors are connected to a copper tube via a coaxial cable external conductor (ground signal). Three of the linear conductors have the same length, which is about one quarter wavelength of the high-frequency electric wave received thereby and transmitted therefrom. The other linear conductor has the length longer than these three linear conductors at about one quarter wavelength of a low-frequency electric wave received thereby and transmitted therefrom. Thereby, an array of dual band antenna is obtained to achieve omni-directional reception and transmission of radiation.

8 Claims, 4 Drawing Sheets

DUAL BAND LINEAR ANTENNA ARRAY

BACKGROUND OF THE INVENTION

The present invention relates generally to a dual band linear antenna developed from the concepts of J-type antenna and array-type antenna to provide dual band wireless communication, and more particularly, to a linear dipole antenna array.

The popularity of portable electric products has speeded up the development of wireless communication technique in recent years. The wireless communication device normally requires two bands to perform signal transmission and reception. For example, for the very popular wireless local area network (WLAND), according to the specification of IEEE 802.11a, b and g, the band width of the communication frequency between the access point (AP) and the WLAND card ranges at 2.4–2.5 GHz and 4.9–5.8 GHz. Therefore, a dual band antenna has to be used for the dual band device to provide the optimal effect.

In the aforementioned wireless local area network, an internal antenna is often adapted to minimize the size and provides aesthetic effect of the WLAN card, while an external antenna is typically used for the access point. FIG. 1 shows a dual band antenna commonly used in the access point. As shown in FIG. 1, a linear copper foil A1 is placed on a printed circuit board A to form a radiator, so as to form a planar antenna. However, such planar antenna has higher directivity. That is, a fan-shaped area outlined by two sides of planar orthogonal line has better transmission and reception, while the reception and transmission are poorer along the extension of the plane (that is, the area parallel to the plane). Further, being blocked by the material of the board, the radiation of the rear surface of the circuit board that does not have the copper foil is affected Other approaches such as adhering two such planar antennas together, or placing copper foil on both sides of the circuit board to form two set of planar antennas is also proposed to improve reception and transmission of electric wave radiation. None of these approaches provides a 360° omni-directional radiation. Therefore, the improvement of radiation along the area parallel to the circuit board is still insignificant. A dead angle still exits for reception and transmission of electric wave.

BRIEF SUMMARY OF THE INVENTION

The present invention provides a dual band linear antennal array which provides omni-directional reception and transmission of electric wave without dead angle. The dual band linear antennal array can be fabricated by simple process with low cost.

The dual band linear antenna array provided by the present invention comprises four hard linear conductors to form a set of radiators. The linear conductors are equidistantly arranged at four corners and parallel to each other. Three of the linear conductors have the same height, which is one quarter wavelength of the high-frequency electric wave received thereby and transmitted therefrom. The other linear conductor has a longer height, which is one quarter wavelength of the low-frequency electric wave received thereby and transmitted therefrom.

BRIEF DESCRIPTION OF THE DRAWINGS

These, as well as other features of the present invention, will become more apparent upon reference to the drawings wherein.

DETAILED DESCRIPTION OF THE INVENTION

Figure 1:
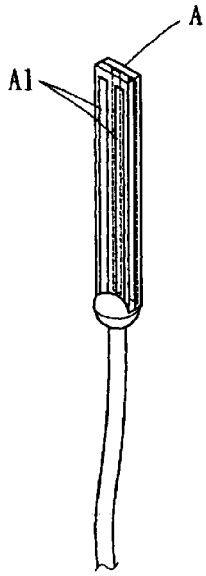
FIG. 1 PRIOR ART
FIG. 1 shows the perspective view of a conventional dual band planar antenna.
Figure 2:
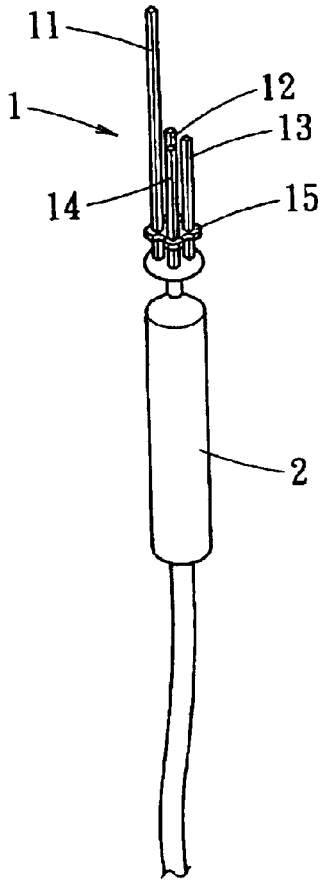
FIG. 2 shows the perspective view of a dual band linear antenna array in a first embodiment of the present invention.
Figure 3:
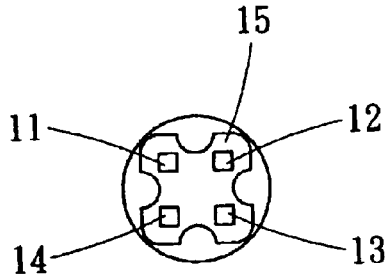
FIG. 3 shows a top view of FIG. 2.

Referring to FIGS. 2 and 3, a perspective view and a top view of a first embodiment of the present invention are provided As shown, a radiator 1 is constructed by four hard linear conductors 11, 12, 13 and 14. The conductors 11, 12, 13 and 14 include non-insulated bare wires with cross sectional areas of about 0.5 $cm^2$. The conductors 11, 12, 13 and 14 are equidistantly rooted at four corners to form a rectangular array. The roots of the conductors 11, 12, 13 and 14 are inserted in a positioning board 15. The positioning board 15 is made of insulating material, for example. Being positioned by the positioning board 15, the roots of the conductors 11, 12, 13 and 14 are then serially connected to a signal feed terminal. By a coaxial cable external conductor (ground signal), the conductors 11, 12, 13 and 14 are connected to a copper tube 2. Three conductors 12, 13, and 14 have the same length, which is preferably one quarter wavelength ($\lambda/4$) of the high-frequency electric wave received thereby and transmitted therefrom. The conductor 11 has a longer length, which is preferably one quarter wavelength of the low-frequency electric wave received thereby and transmitted therefrom. When 2.4–2.5 GHz and 4.9–5.8 GHz are two bands to be received by and transmitted from the radiator 1, the length of the conductor 11 is about 2.2 cm, while the length of the conductors 12, 13 and 14 is about 1.2 cm. The specific lengths of the conductors 11, 12, 13 and 14 depend on the wavelength of the electric wave to be received thereby and transmitted therefrom. The material for fabricating the conductors 11, 12, 13, and 14, and the diameters of and the space between the conductors 11, 12, 13 and 14 may also vary the lengths thereof. By the present invention, a dual band antenna with an omni-directional radiation is obtained. As multiple linear antennas are used to assemble the antenna array, no dead angle exists, and the omni-directional radiation is achieved. Therefore, the radiation field and gain of the antenna are greatly enhanced.

Figure 4:
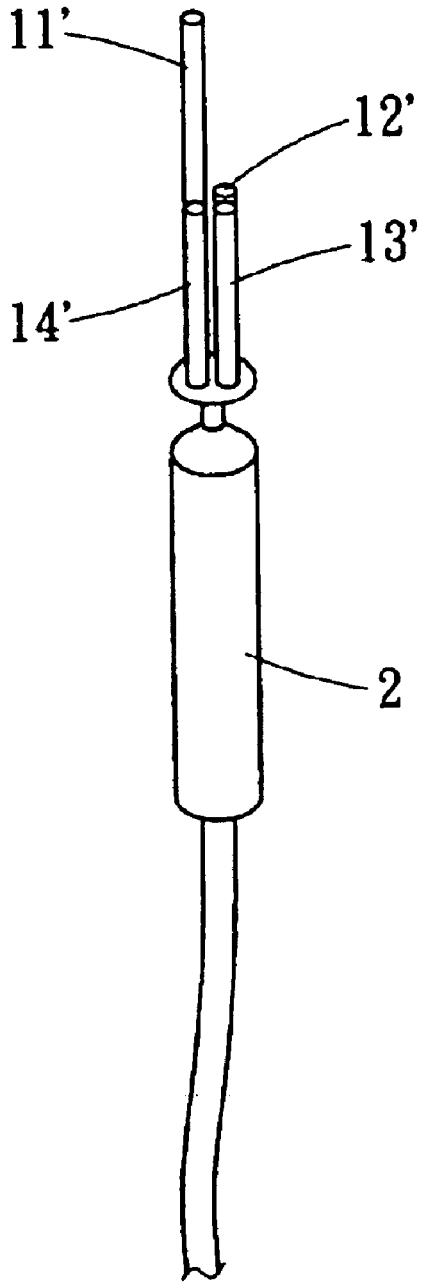
FIG. 4 shows the perspective view of a dual band linear antenna array in a second embodiment of the present invention.
Figure 5:
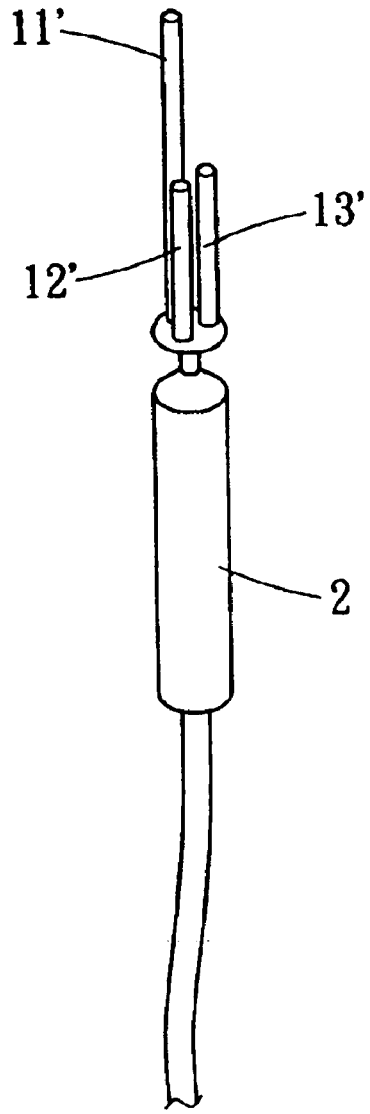
FIG. 5 shows the perspective view of a dual band linear antenna array in a third embodiment of the present invention.

FIG. 4 shows the perspective view of the second embodiment of the present invention. In this embodiment, four conductors 11', 12', 13' and 14' for forming the radiator include linear magnet wires with circular cross sections. Similarly, one of the conductors 11', 12', 13' and 14' is longer than the other three. The longer conductor has a quarter wavelength of the low-frequency electric wave, while the shorter conductors have a quarter wavelength of the high-frequency electric wave to be received and transmitted. FIG. 5 shows the third embodiment of the present invention, in which only three conductors 11', 12' and 13' are used to form the radiator. The conductors 11', 12' and 13' are equidistantly rooted in a triangle. Similarly, one of the conductors is longer than the other two.

According to the above, the present invention uses the concept of J-type antenna and array-type antenna to design an omni-directional radiation field and an improved gain with relatively low cost and simple fabrication process.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. A dual band linear antenna array, comprising four hard linear conductors to form a radiator, wherein the conductors are equidistantly rooted at four corners and parallel to each other, wherein three of the conductors have a first length of one quarter wavelength of a first electric wave to be transmitted and received, and one of the conductor has a second length of one quarter wavelength of a second electric wave to be transmitted and received, the first length is shorter than the second length, and the first electric wave has a frequency higher than that of the second electric wave.

2. The antenna array of claim 1, wherein the roots of the conductors are serially connected to a signal feed terminal, and the conductors are connected to a copper tube via a coaxial cable external conductor.

3. The antenna array of claim 1, wherein the conductors include non-insulated bare wires.

4. The antenna array of claim 1, wherein each of the conductors has a rectangular cross section.

5. The antenna array of claim 1, wherein the roots of the conductors inserted in a positioning board made of insulation material.

6. The antenna array of claim 1, wherein the conductors include magnet wires.

7. The antenna array of claim 1, wherein each of the conductors has a circular cross section.

8. A dual band linear antenna array, comprising three hard linear conductors to form a radiator, wherein the conductors are equidistantly rooted at three corners and parallel to each other, wherein two of the conductors have a first length of one quarter wavelength of a first electric wave to be transmitted and received, and one of the conductor has a second length of one quarter wavelength of a second electric wave to be transmitted and received, the first length is shorter than the second length, and the first electric wave has a frequency higher than that of the second electric wave.

* * * * *